US006708514B1

(12) United States Patent
Miller

(10) Patent No.: US 6,708,514 B1
(45) Date of Patent: Mar. 23, 2004

(54) AIR CONDITIONER COVER

(76) Inventor: William F. Miller, 174 Farmersville Rd., So. Sandwich, MA (US) 02563-2640

( * ) Notice: Subject to any disclaimer, the term of this patent is extended or adjusted under 35 U.S.C. 154(b) by 25 days.

(21) Appl. No.: 10/046,051

(22) Filed: Jan. 16, 2002

(51) Int. Cl.[7] ..... F25D 25/02; F25B 39/04
(52) U.S. Cl. ..... 62/259.1; 62/507
(58) Field of Search ..... 62/259.1, 507, 62/506; 55/385.1, 500

(56) References Cited

U.S. PATENT DOCUMENTS

| | | | | |
|---|---|---|---|---|
| 2,711,769 A | | 6/1955 | Katcher et al. | |
| 2,720,236 A | | 10/1955 | Hoffman | |
| 3,320,996 A | | 5/1967 | Singer | |
| 4,498,912 A | | 2/1985 | Wagner | |
| 4,745,769 A | | 5/1988 | Wooden, Jr. | |
| 5,097,678 A | | 3/1992 | Aubuchon | |
| 5,307,849 A | | 5/1994 | Nelson | |
| 5,311,813 A | * | 5/1994 | Fairbanks et al. | 99/645 |
| 5,678,587 A | * | 10/1997 | Bilotti | 135/98 |
| 5,803,391 A | | 9/1998 | Saperstein et al. | |
| 5,809,800 A | * | 9/1998 | Deal | 62/507 |

FOREIGN PATENT DOCUMENTS

JP 2000051581 A * 2/2000 ..... D06F/57/00

* cited by examiner

*Primary Examiner*—Chen Wen Jiang
(74) *Attorney, Agent, or Firm*—John P. McGonagle

(57) ABSTRACT

A mesh-type air conditioner cover adapted to cover an entire outdoor air conditioner unit. The cover is comprised of a horizontal mesh top panel joined to an attachment skirt extending perpendicularly downward therefrom. A mesh extended skirt protrudes downwardly from the attachment skirt covering the remainder of the air conditioner unit.

12 Claims, 4 Drawing Sheets

AIR CONDITIONER COVER

BACKGROUND OF THE INVENTION

This invention relates to air conditioners, and in particular to a cover for an outdoor air conditioner unit.

Split system air conditioners are widely used in which an outdoor unit houses the compressor, condenser, fan, and control components. The outdoor unit is installed near the exterior of the building in which the evaporator is located.

Split system air conditioners are usually made with an open-grill construction to eliminate moisture build-up within the unit. However, the open-grill construction exposes the unit's motor and other operative parts to debris such as leaves. Protective covers for outdoor units are known in which a shroud of flexible, weather resistant material envelops the outdoor unit to protect against the weather, moisture, dirt, leaf particles, and other debris when the unit is not in use. However, these protective covers are moisture impervious and permit humidity to develop under the cover within the unit thereby corroding the structure and operative parts of the unit.

SUMMARY OF THE INVENTION

The present invention's general purpose is to overcome the difficulties with prior art outdoor air conditioning units by providing a mesh-type air conditioner cover adapted to cover an entire outdoor unit. The mesh-type construction of the invention cover keeps a substantial amount of debris out of the air conditioner while eliminating humidity build-up.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
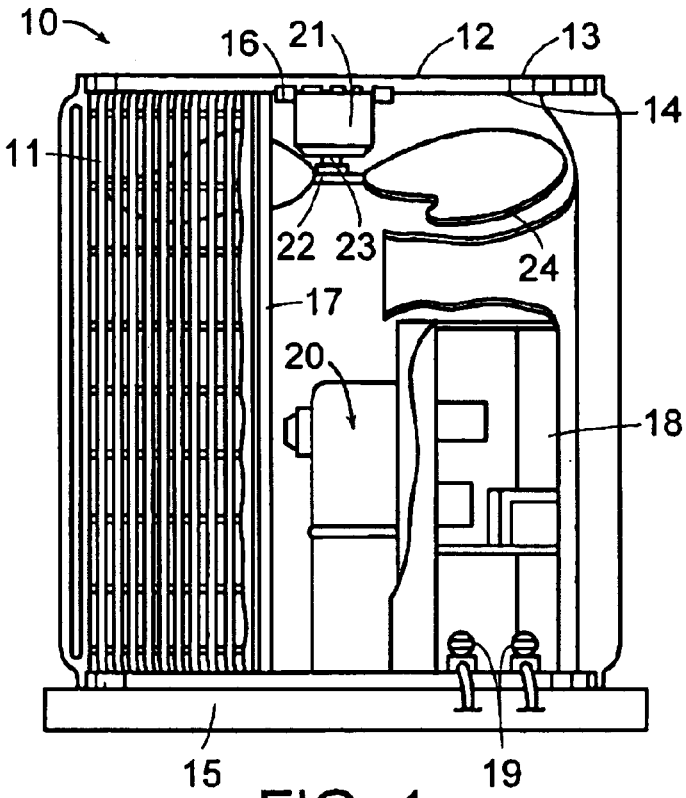
FIG. 1 is an elevational view, partly broken away, of the exterior condenser unit of a split system air conditioner whose air inlet grill and finned coil are partially broken away to show its operative components.
Figure 2:
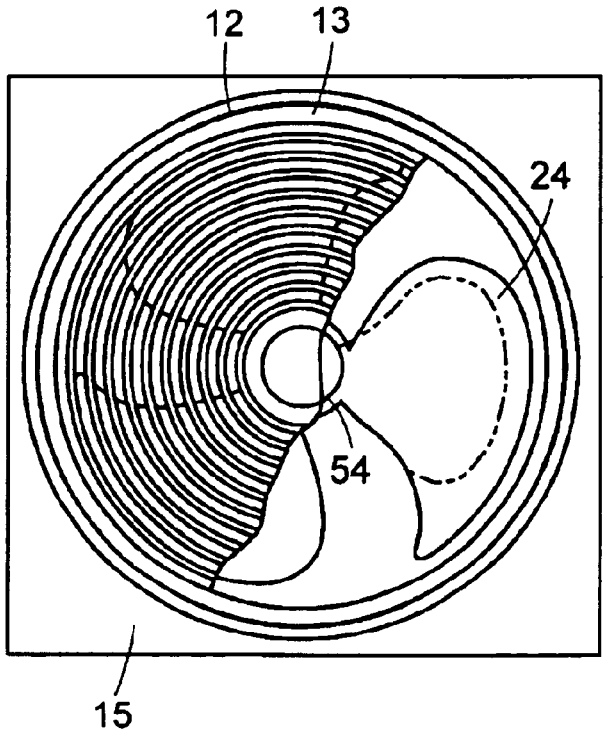
FIG. 2 is a top view of the unit of FIG. 1.

Referring to the drawings in detail wherein like elements are indicated by like numerals, there is shown in FIGS. 1 and 2 a conventional top discharge exterior condenser unit 10 of a split system air conditioner resting on a concrete base pad 15. The condenser has a top with a outlet grill 12 centrally positioned therein a nearly circumferential vertical finned heat exchanger coil 17 sheathed by a protective air inlet grill 11, conventional sealed operating components 20 substantially centered at the base of the condenser 10 within the heat exchanger coil 17, and a control unit 18 housing conventional refrigerant valves 19. The top outlet grill 12 has a horizontal outer surface 13 and a horizontal under surface 14. A compressor fan motor 21 is centrally mounted on a central plate 16 attached to the undersurface 14 of the top outlet grill 12. A motor shaft 22 extends vertically downward from the fan motor 21 and terminates in a hub 23 bearing a plurality of horizontal fan blades 24. When the unit 10 is in operation, air flows unrestrictedly into the air inlet grill 11 and out through the open outlet grill 12.

Figure 3:
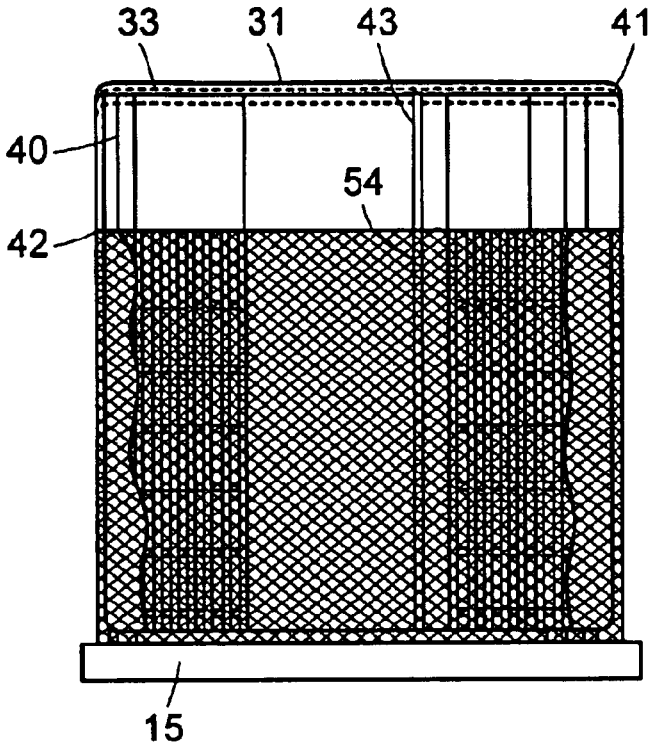
FIG. 3 is an elevational view of the protective cover of the present invention, secured onto the compressor unit such as that of FIG. 1.
Figure 4:
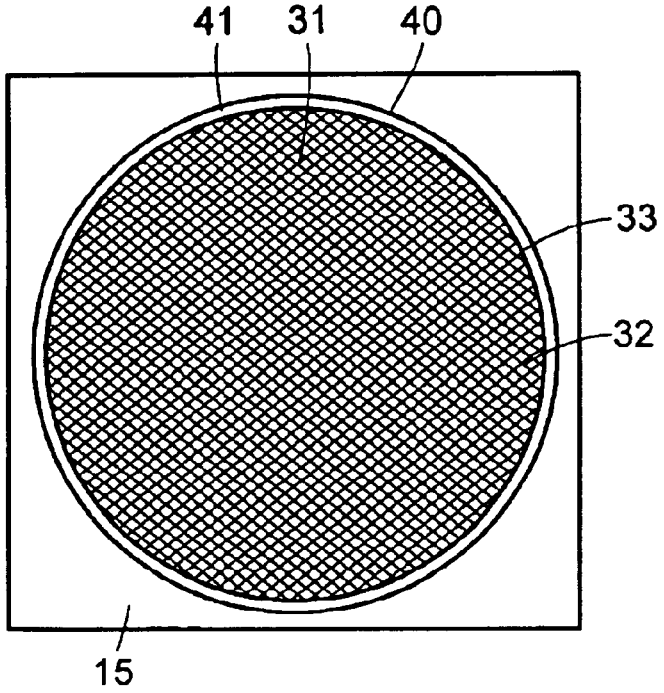
FIG. 4 is a top view of the cover shown in FIG. 3.
Figure 5:
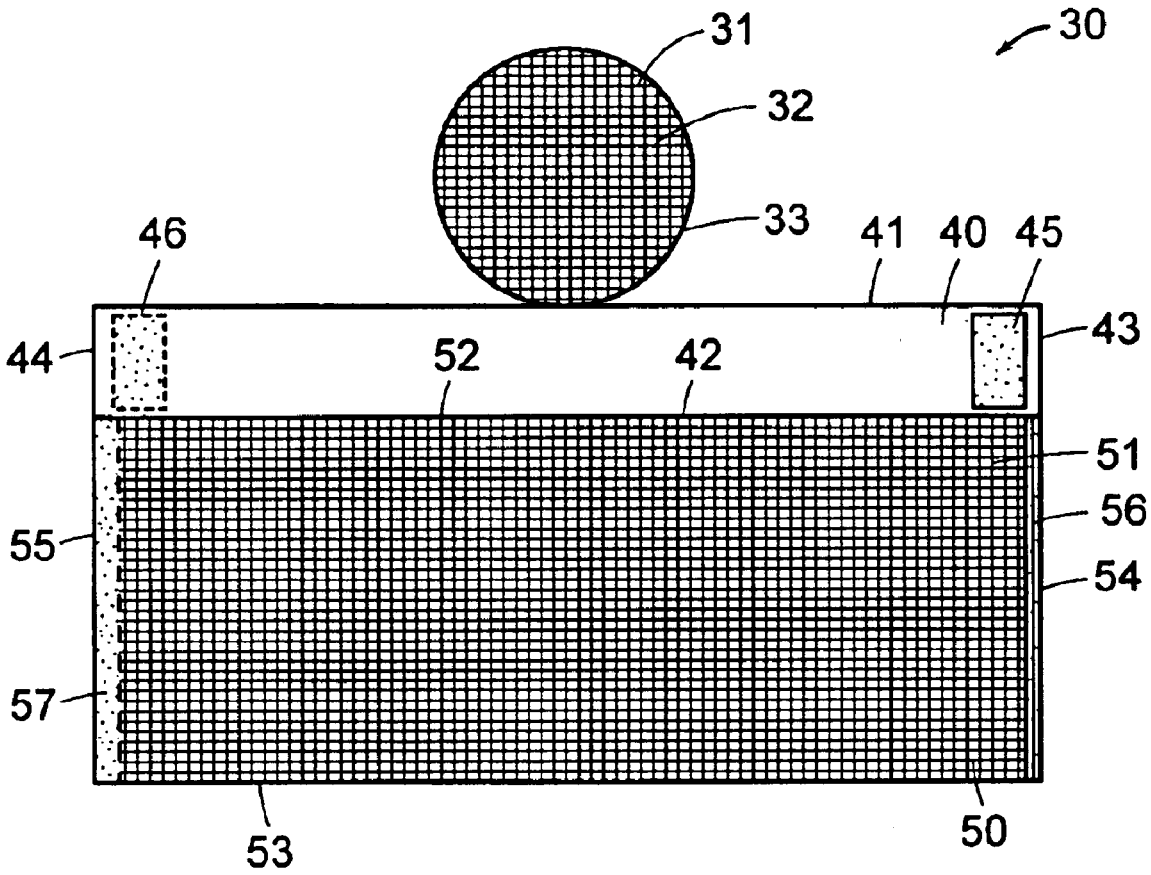
FIG. 5 is a diagrammic view of the cover shown in FIGS. 3 and 4.

One embodiment of the cover 30 of the present invention is shown in diagram in FIG. 5 and illustrated in FIGS. 3 and 4 covering the condenser unit 10 described above. The cover 30 is comprised of a mesh top panel 31, an attachment skirt 40 and a mesh extended skirt 50. The top panel 31 is comprised of a relatively fine mesh 32, and is adapted to lay horizontally flat upon and extending to but not beyond the top outlet grill 12, thereby shielding the horizontal outer surface 13 of the outlet grill 12 from debris. Particles finer than the top panel mesh 32 will fall through the condenser unit 10 to the base pad 15. The mesh structure of the top panel 31 permits air and moisture within the condenser unit 10 to freely pass up and through the top outlet grill 12, out of the condenser unit 10, and through the cover top panel 31. The cover top panel 31 may be constructed from a durable, weather impervious material. The top panel 31 has an outer perimeter edge 33 to which is joined an attachment skirt 40 which extends perpendicularly downward from said top panel perimeter edge 33. The top panel outer perimeter edge 33 may be fixedly joined to the attachment skirt 40 or may be removably joined such as by means of a weather resistant zipper.

The attachment skirt 40 is an elongated, flexible element having an elongated upper edge 41, an elongated lower edge 42 and two side ends 43, 44 with attachment means 45, 46 at each end. The two side ends 43, 44 define the elongated central axis of the attachment skirt 40. The attachment means 45, 46 may be comprised of hook and pile fasteners, sold under the Velcro trademark. A Velcro strip 45 may be affixed to one skirt side end 43 and a matching Velcro strip 46 attached to the other skirt side end 44, said strips adapted to engage each other in a fastener relationship. The attachment skirt 40 is adapted to snugly and radially fit about the condenser unit 10 adjacent to the top outlet grill 12. The skirt attachment means 45, 46 provide adjustment means for condenser units of varying diameters as well as shapes. The attachment skirt 40 may be constructed from a durable, weather resistant heavy grade vinyl or vinyl impregnated cloth. The attachment skirt upper edge 41 is fixedly attached to said top panel outer perimeter edge 33. The attachment skirt lower edge 42 is fixedly joined to said mesh extended skirt 50 which extends downwardly from said attachment skirt 40 about the condenser unit 10.

The mesh extended skirt 50 has a generally rectangular shape and is comprised of a relatively fine mesh 51 and is adapted to lay vertically about the condenser unit 10. The mesh extended skirt 50 has two long edges 52, 53 and two short edges 54, 55. One long edge 52 is fixedly joined to the attachment skirt lower edge 42. The opposite long edge 53 forms a cover bottom. The short edges 54, 55 may have attachment means 56, 57 along each edge. The attachment means 56, 57 may be comprised of hook and pile fasteners, sold under the Velcro trademark. A Velcro strip 56 may be affixed along one short edge 54 and a matching Velcro strip 57 attached to the other short edge 55, said strips adapted to engage each other in a fastener relationship. The mesh structure of the mesh extended skirt 50 permits air to freely pass into and through the condenser unit 10, through the top outlet grill 12, out of the condenser unit 10, and through the cover top panel 31. The mesh extended skirt attachment means 56, 57 provide adjustment means for condenser units of varying diameters as well as shapes. The mesh extended skirt 50 may be constructed from a durable, weather impervious material.

Figure 6:
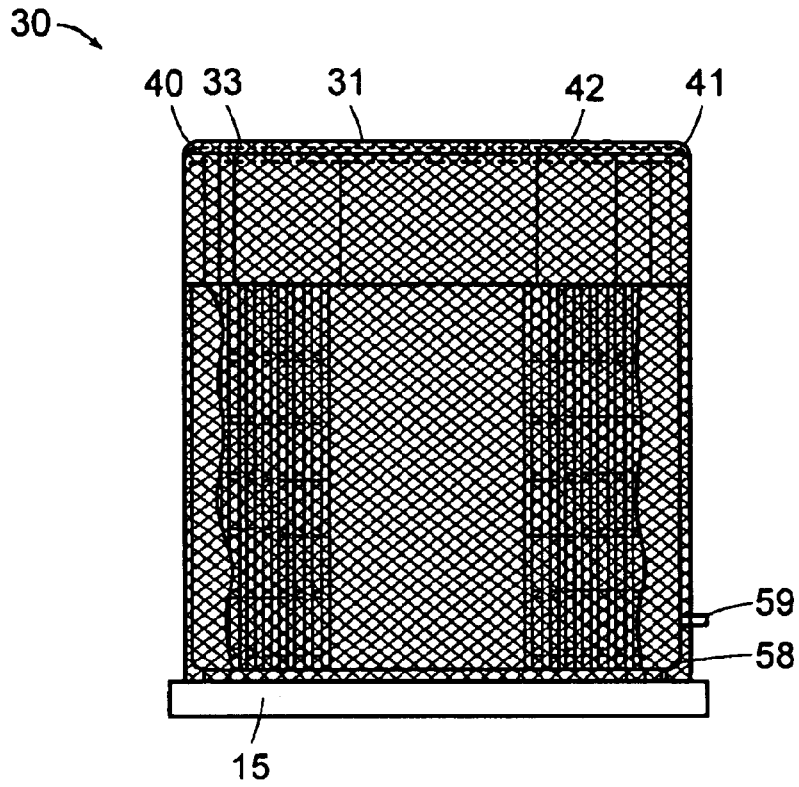
FIG. 6 is an elevational view of a second embodiment of the protective cover of the present invention, secured onto the compressor unit such as that of FIG. 1.
Figure 7:
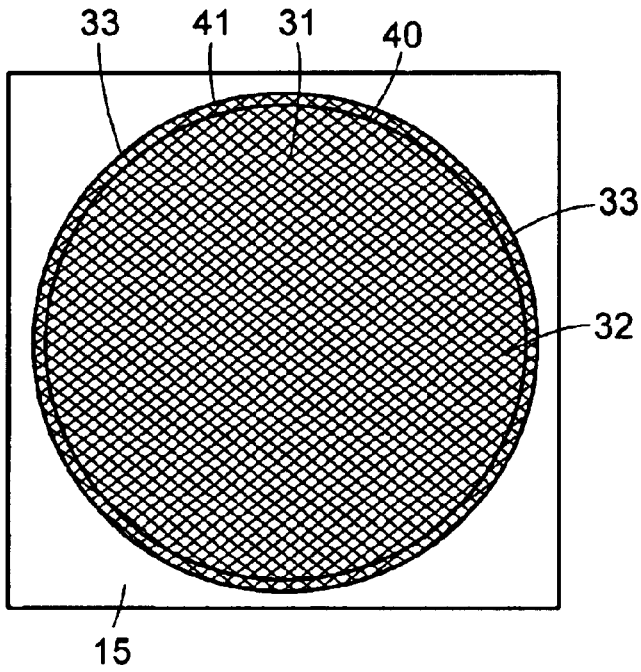
FIG. 7 is a top view of the cover shown in FIG. 6.

In another embodiment of the invention illustrated in FIGS. 6 and 7, the top panel 31, attachment skirt 40 and extended skirt 50 of the cover 30 are comprised of a continuous, stretchable mesh weave. The attachment skirt of the first embodiment is replaced with an elasticized portion 40 about the outer perimeter edge 33 of the cover top panel 31 joining with and extending through the extended skirt 50. The extended skirt bottom edge 53 has an opening 58 formed therein allowing condenser refrigerant piping to pass through the cover 30. The opening 58 is approximately two inches by two inches and is sealable with a hook and pile type fastener 59. In this embodiment of the invention, the mesh is made from a breathable elastomeric material. The mesh cover 30 may have various shapes such as round, rectangular, square, etc., and can be either tall, squat or cube shaped.

It is understood that the above-described embodiment is merely illustrative of the application. Other embodiments may be readily devised by those skilled in the art which will embody the principles of the invention and fall within the spirit and scope thereof.

I claim:

1. A cover for a split system air conditioner top discharge exterior condenser unit resting on a base pad, said condenser having a top with an outlet grill centrally positioned therein, a nearly circumferential vertical finned heat exchanger coil sheathed by a protective air inlet grill, conventional sealed operating components substantially centered at the base of the condenser within the heat exchanger coil, and a control unit housing conventional refrigerant valves, said top outlet grill having a horizontal outer surface and a horizontal under surface, comprising:

a mesh top panel comprised of a relatively fine mesh, said mesh top panel adapted to lay horizontally flat upon and extending to the top outlet grill, said mesh top panel having an outer perimeter edge;

an attachment skirt joined to said mesh top panel; and a mesh extended skirt joined to said attachment skirt.

2. A cover as recited in claim 1, wherein:

said attachment skirt is joined to said top panel outer perimeter edge, said attachment skirt extending perpendicularly downward from said top panel outer perimeter edge.

3. A cover as recited in claim 2, wherein:

said mesh extended skirt has a generally rectangular shape, is comprised of a relatively fine mesh and is adapted to lay vertically about the condenser unit, said mesh extended skirt having two long edges and two short edges, one said long edge being joined to the attachment skirt lower edge, said other long edge forming a cover bottom.

4. A cover as recited in claim 3, wherein:

said mesh extended skirt short edges having attachment means along each edge adapted to engage each other in a fastener relationship.

5. A cover as recited in claim 4, wherein:

said attachment skirt is removably joined to said top panel outer perimeter edge by means of a weather resistant fastener.

6. A cover as recited in claim 5, wherein:

said attachment skirt is an elongated, flexible element having an elongated upper edge, an elongated lower edge and two side ends with attachment means at each end, said two side ends defining an elongated central axis of the attachment skirt, said attachment means adapted to engage each other in a fastener relationship, said attachment skirt being adapted to snugly and radially fit about the condenser unit adjacent to the top outlet grill.

7. A cover as recited in claim 6, wherein:

said attachment skirt is constructed from a durable, weather resistant heavy grade material, said attachment skirt upper edge being attached to said top panel outer perimeter edge, said attachment skirt lower edge being joined to said mesh extended skirt.

8. A cover for a split system air conditioner top discharge exterior condenser unit resting on a base pad, said condenser having a top with an outlet grill centrally positioned therein, a nearly circumferential vertical finned heat exchanger coil sheathed by a protective air inlet grill, conventional sealed operating components substantially centered at the base of the condenser within the heat exchanger coil, and a control unit housing conventional refrigerant valves, said top outlet grill having a horizontal outer surface and a horizontal under surface, comprising:

a mesh top panel adapted to lay horizontally flat upon the top outlet grill, said mesh top panel having an outer perimeter edge;

an attachment skirt joined to said mesh top panel;

a mesh extended skirt Joined to said attachment skirt;

wherein said mesh top panel, attachment skirt and mesh extended skirt are comprised of a continuous, stretchable mesh weave.

9. A cover as recited in claim 8, wherein:

said attachment skirt is elasticized and joined to the outer perimeter edge of the mesh top panel.

10. A cover as recited in claim 9, wherein:

said mesh extended skirt is joined to said attachment skirt and is adapted to lay vertically about the condenser unit.

11. A cover as recited in claim 10, wherein:

said mesh extended skirt has a bottom edge with an opening formed, said opening being sealable with a fastener.

12. A cover as recited in claim 11, wherein:

said continuous, stretchable mesh weave is made from a breathable elastomeric material.

* * * * *